US009359886B2

(12) United States Patent
Cameron

(10) Patent No.: US 9,359,886 B2
(45) Date of Patent: Jun. 7, 2016

(54) SYSTEM AND METHOD FOR PROVIDING A REPLENISHABLE RECEPTACLE FOR TAGGER AND/OR TRACER MATERIAL IN A WELLBORE

(71) Applicant: Chevron U.S.A. Inc., San Ramon, CA (US)

(72) Inventor: John Alasdair Cameron, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/243,010

(22) Filed: Apr. 2, 2014

(65) Prior Publication Data

US 2014/0299756 A1 Oct. 9, 2014

Related U.S. Application Data

(60) Provisional application No. 61/809,913, filed on Apr. 9, 2013.

(51) Int. Cl.
*E21B 47/10* (2012.01)
*E21B 27/02* (2006.01)

(52) U.S. Cl.
CPC ..... *E21B 47/1015* (2013.01); *E21B 27/02* (2013.01)

(58) Field of Classification Search
CPC ..... E21B 47/1015; E21B 47/10; E21B 47/00; E21B 2049/085; E21B 47/124
USPC ..... 250/259
See application file for complete search history.

(56) References Cited

U.S. PATENT DOCUMENTS

| | | | | | |
|---|---|---|---|---|---|
| 4,507,552 | A * | 3/1985 | Roesner et al. | ..... | 250/259 |
| 4,558,219 | A * | 12/1985 | LeBlanc et al. | ..... | 250/260 |
| 4,622,463 | A * | 11/1986 | Hill | ..... | 250/259 |
| 4,805,450 | A * | 2/1989 | Bennett et al. | ..... | 73/152.29 |
| 4,871,116 | A * | 10/1989 | Banner | ..... | 241/21 |
| 5,533,978 | A * | 7/1996 | Teirstein | ..... | 604/183 |
| 6,164,127 | A * | 12/2000 | Izbicki et al. | ..... | 73/152.23 |
| 6,799,634 | B2 * | 10/2004 | Hartog et al. | ..... | 166/250.12 |
| 2003/0056952 | A1 * | 3/2003 | Stegemeier et al. | ..... | 166/250.12 |
| 2012/0090835 | A1 * | 4/2012 | Kefi | ..... | 166/252.6 |
| 2013/0075090 | A1 * | 3/2013 | Woiceshyn | ..... | 166/250.12 |

* cited by examiner

*Primary Examiner* — Marcus Taningco
(74) *Attorney, Agent, or Firm* — Pillsbury Winthrop Shaw Pittman LLP

(57) ABSTRACT

This disclosure relates to systems and methods associated with a replenishable receptacle for tagger and/or tracer material in a wellbore. The system may include a receptacle configured to contain tracer material and release tracer material into fluid flowing in a wellbore responsive to the fluid flowing adjacent to the receptacle. The tracer material includes a distinctive element or chemical configured to facilitate determining information associated with movement of fluid in the wellbore. A rate of the release of the tracer material may be related to a rate of flow of the fluid in the wellbore. The receptacle may be further configured to be refilled with tracer material responsive to the tracer material contained by the receptacle being depleted. Refilling the receptacle may be performed via one or more of a wireline, a coiled tubing, a tractor, a robot, a work-string and/or tubing from a light intervention vessel, and/or other approaches.

11 Claims, 7 Drawing Sheets

SYSTEM AND METHOD FOR PROVIDING A REPLENISHABLE RECEPTACLE FOR TAGGER AND/OR TRACER MATERIAL IN A WELLBORE

CROSS REFERENCE TO RELATED APPLICATIONS

This application is based upon and claims the benefit of priority from U.S. provisional application 61/809,913, filed Apr. 9, 2013; the entire contents of which are incorporated herein by reference.

FIELD OF THE DISCLOSURE

This disclosure relates to systems and methods associated with a replenishable receptacle for tagger and/or tracer material in a wellbore.

BACKGROUND

Regulatory authorities and energy companies often require quantification of production and allocation of remaining reserves by producing zone for individual reservoirs and/or fields. For oil and gas wells producing from multiple zones, this is performed by reservoir monitoring through production logging and interventions into a producing well, or by incorporation of permanent instrumentation in the wellbore. More contemporary techniques to monitor production include use of tagging and/or tracer technologies (e.g., chemical, radioactive, and/or other technologies).

Performing production logs on high-rate subsea gas wells using existing techniques can be problematic. For example, the maximum rate that can be measured with a production logging tool during a well intervention may be much less than the normal well flow rates during production, rendering the acquired data questionable. Furthermore, using permanent down-hole flow measurement instrumentation can add to rig-time and complexity of a well completion, may detract from well reliability and integrity due to use of controls lines, may impede overall production rates by reducing the production inner diameter, and may present uncertainty as to the reliability of installed instrumentation at elevated levels of vibration, pressure, and temperature. As to existing tagging and tracer technology, it has a limited lifetime (e.g., one to two years) and thus cannot be expected to operate for the entire duration of the well life.

SUMMARY

One aspect of the disclosure relates to a system configured to provide a replenishable receptacle for a tracer material in a wellbore. The system comprises a first receptacle configured to contain tracer material and release tracer material into fluid flowing in a wellbore responsive to the fluid flowing adjacent to the first receptacle. The tracer material includes a distinctive element or chemical configured to facilitate determining information associated with presence and/or movement of fluid in the wellbore. Timing and/or rate of the release of the tracer materials is related to a rate of flow of the fluid in the wellbore. The first receptacle is further configured to be refilled with tracer material responsive to the tracer material contained by the first receptacle being depleted or require changing.

Another aspect of the disclosure relates to a method for replenishing a tracer material receptacle in a wellbore. The method comprises: shutting in the wellbore (or reducing production, if so required for safety and/or operational reasons) such that fluid in the wellbore ceases to flow responsive to tracer material contained by the receptacle being depleted, the tracer material including a distinctive element or chemical configured to facilitate determining information associated with movement of fluid in the wellbore; refilling the receptacle with tracer material; and returning production of the wellbore to a normal rate responsive to the receptacle being refilled, tracer material contained by the receptacle being released into fluid flowing in the wellbore responsive to the fluid flowing adjacent to the receptacle.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

FIG. 3A illustrates a sectional view of a tracer material receptacle assembly 300, while

DETAILED DESCRIPTION

Exemplary implementations provide replenishable receptacles configured to contain and release tagging and/or tracer materials in the wellbore. Such receptacles may be installable above individual producing zones in the wellbore. According to various implementations, tagging and/or tracer materials may be installed into the receptacle(s) via wireline, coiled tubing, tractor, robot, work-strings and tubing from a light intervention vessel, and/or other approaches. The tagging and/or tracer materials may be installed while the well is shut in for a period of time. Once the tagging and/or tracer material is replenished in the receptacle(s), the well may be returned to normal (e.g., half-rate, full-rate, and/or other normal rate) production. The time of arrival, concentration, and/or other parameters associated with the tagging and/or tracer material can be used to determine relative production on a zone-by-zone basis in the well. In some implementations, individual receptacles may be configured to house memory devices configured to measure and/or store information associated with pressure, temperature, flow, and/or other parameters. Such memory devices may be retrieved after a flow period. Exemplary implementations may be practiced in multi-lateral wells, intelligent well completions (IWCs), commingled completions, and/or other types of wells. As used herein, the terms "tagging material" and "tracer material" are interchangeable, and describe any distinctive element or chemical used to trace movement of fluid (e.g., liquid and/or gas) in a reservoir and/or well.

Figure 1:
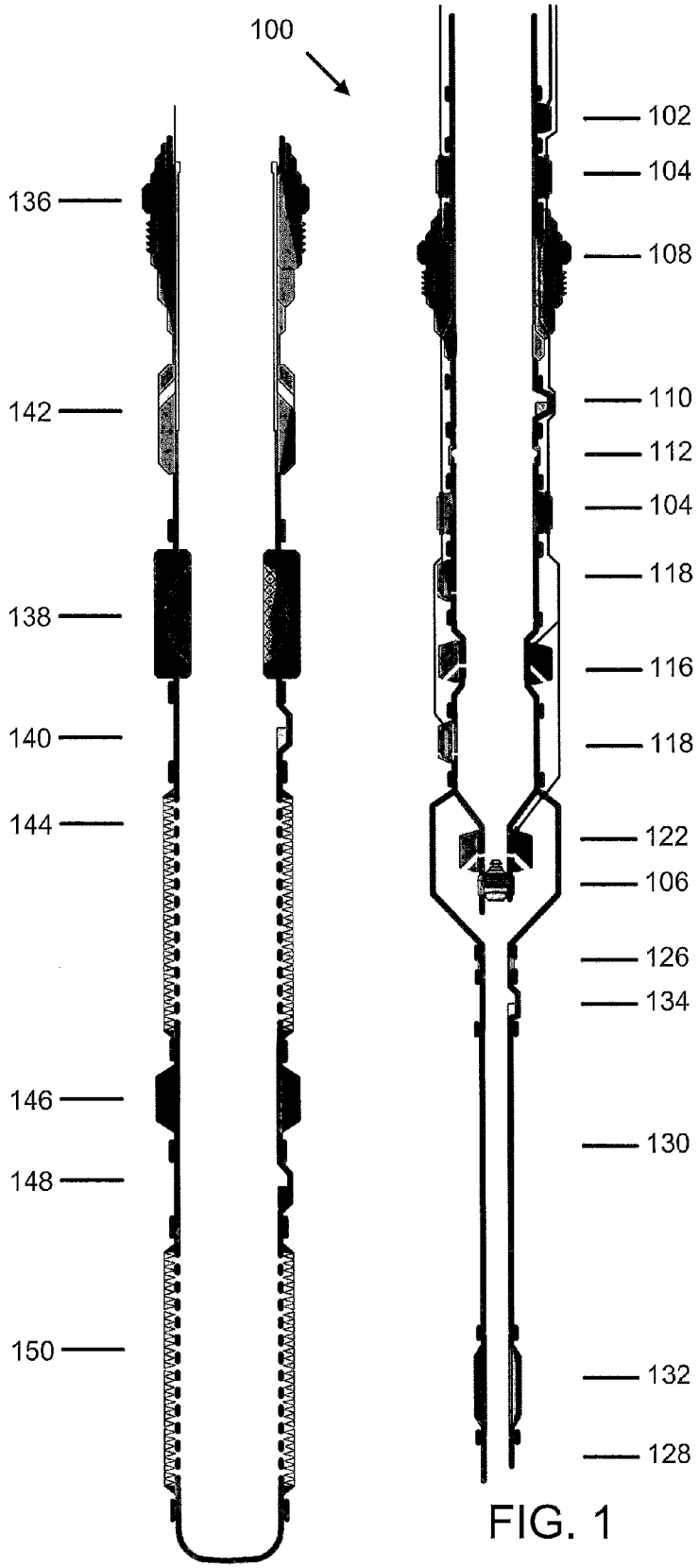
FIG. 1 illustrates a system configured provide a replenishable receptacle for tagger and/or tracer material in a wellbore, in accordance with one or more implementations.

FIG. 1 illustrates a system 100 configured provide a replenishable receptacle for tagger and/or tracer material in a wellbore, in accordance with one or more implementations. System 100 may include various apparatus associated with a wellbore. More specifically, system 100 may include one or more of a chemical injection port 102, a control line splice hub 104, a tubing plug set in a nipple profile 106, a production packer 108, a tracer material receptacle 110, a nipple 112, inlet valve 116 (e.g., an annulus inflow valve), a pressure and/or temperature gauge package 118, a shrouded tubing flow valve 122, a tubing swivel 126, a wireline entry guide 128, stinger tubing 130, a seal assembly 132, a tracer material receptacle 134, a GP packer assembly 136, a formation isolation valve 138, a tracer material receptacle 140, GP Xover port assembly 142, a sand screen 144 (which may be of various designs to suit the sand control application including shunted and gravel packed), an isolation packer 146 (e.g., swell-type) with seal bore, a tracer material receptacle 148, a sand screen 150 (e.g., gravel packed, OH under-reamed as 144), and/or other components. Although system 100 is shown in FIG. 1 as including components 102-150, this is not intended to be limiting as system 100 may include more or less component than those shown. Additionally, different arrangements of components of system 100 are within the scope of the disclosure. Many components of system 100 are known in the art and do not require description herein (e.g., valves, flappers, telescoping joints, side-pocket mandrels, Venturi or other flowmeters, adapters, tubing, and ports). The components of system 100 may form or be associated with a wellbore that is associated with a sand-control well, open or cased well, multi-lateral well, an intelligent well completion, a commingled completion, and/or other type of well.

A tracer material receptacle, such as tracer material receptacles 110, 134, 140, and/or 148, may be configured to contain tracer material. The tracer material may include a distinctive element or chemical configured to facilitate determining information associated with presence and/or movement of fluid in a wellbore. The tracer material receptacle may be configured to release tracer material into fluid flowing in the wellbore responsive to fluid flowing adjacent to the tracer material receptacle. The timing and/or rate of the release of the tracer material may be related to a rate of flow of the fluid in the wellbore.

A given tracer material receptacle (e.g., tracer material receptacles 110, 134, 140, and/or 148) may be configured to be refilled with new tracer material responsive to the tracer material contained by the given tracer material receptacle being depleted (e.g., partially depleted or completely depleted) and/or requiring to be changed out or replenished for other purposes. According to some implementations, the given tracer material receptacle may be refilled with tracer material via one or more of a wireline, a tractor, a robot, tubing from a light intervention vessel, and/or other approaches. Refilling tracer material receptacles may require the wellbore to be shut in, in some implementations.

A given tracer material receptacle may be configured to be installed above a producing zone in the wellbore. For example, referring to FIG. 1, tracer material receptacle 140 is shown as being installed above sand screen 144, while tracer material receptacle 148 is shown as being installed above sand screen 150. Sand screen 144 and sand screen 150 may define different producing zones or regions within the wellbore. A first tracer material receptacle (e.g., tracer material receptacle 140) may be associated with a first zone in the wellbore (e.g., provided by shrouded shunted sand screen 144) and a second tracer material receptacle (e.g., tracer material receptacle 148) may be associated with a second zone in the wellbore (e.g., provided by shrouded shunted sand screen 150). The first receptacle and the second receptacle may be configured to contain different types of tracer materials to facilitate determination of a first flow rate and/or fluid composition associated with first zone and a second flow rate and/or fluid composition associated with the second zone. Individual receptacles may be configured to be opened or closed responsive to instructions received from a remote location (e.g., Earth's surface, ocean bed surface, ocean surface, and/or other remote location). Such instructions may be provided by one or more well communication systems (not depicted). Examples of we communication systems may include one or more of acoustic telemetry, pressure pulses, hydraulic lines, electrical control lines, and/or other communication systems.

In some implementations, a given receptacle (e.g., tracer material receptacles 110, 134, 140, and/or 148) may be configured to house a memory device (not shown). Such a memory device may be configured to measure and store information associated with one or more of pressure, temperature, flow rate, and/or other parameters associated with fluid in the wellbore. The memory device can be retrieved after the required flowing period for analysis and reporting.

Figure 2A:
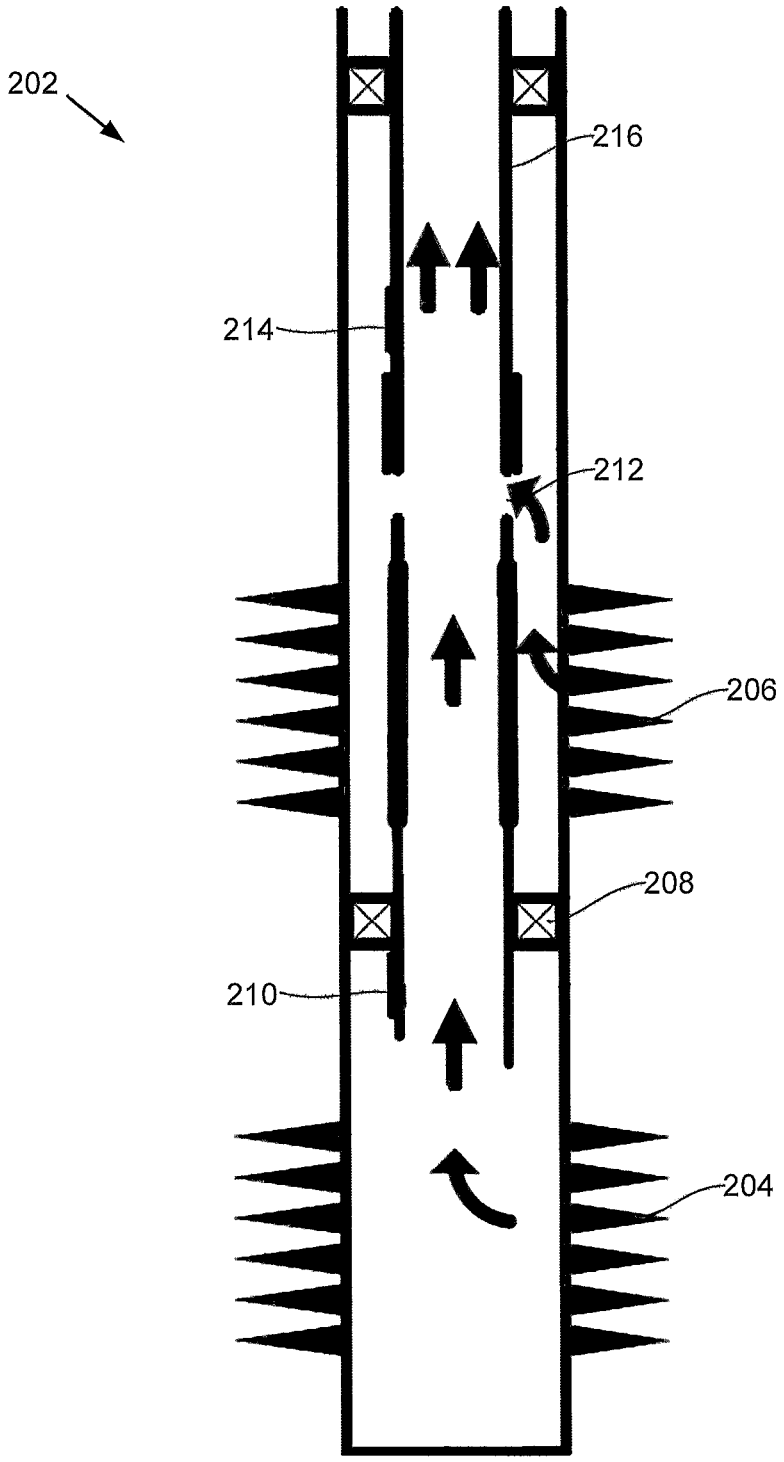
FIGS. 2A, 2B, and 2C illustrate various multiple production zone configurations, in accordance with one or more implementations.
Figure 2B:
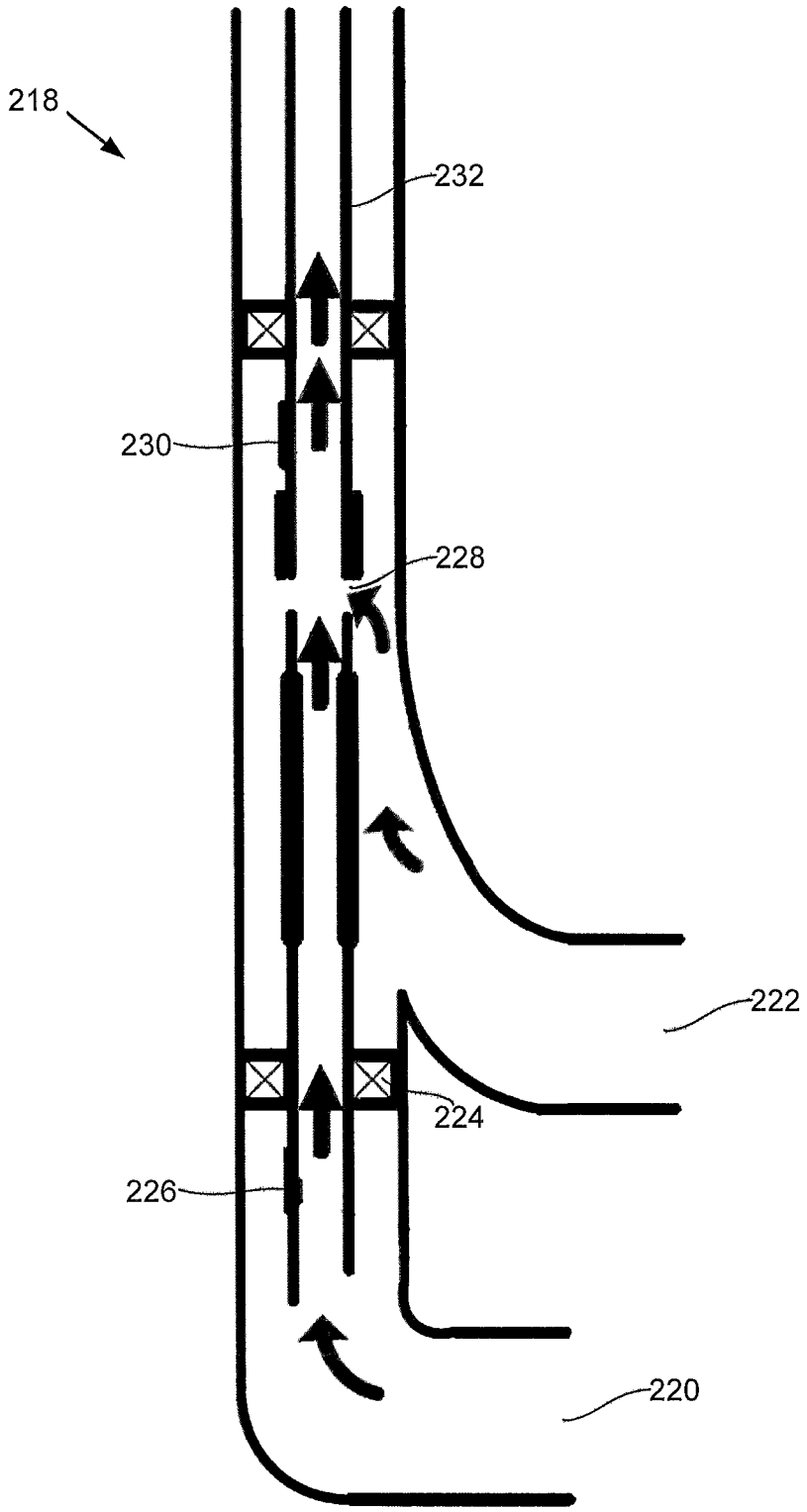
Figure 2C:
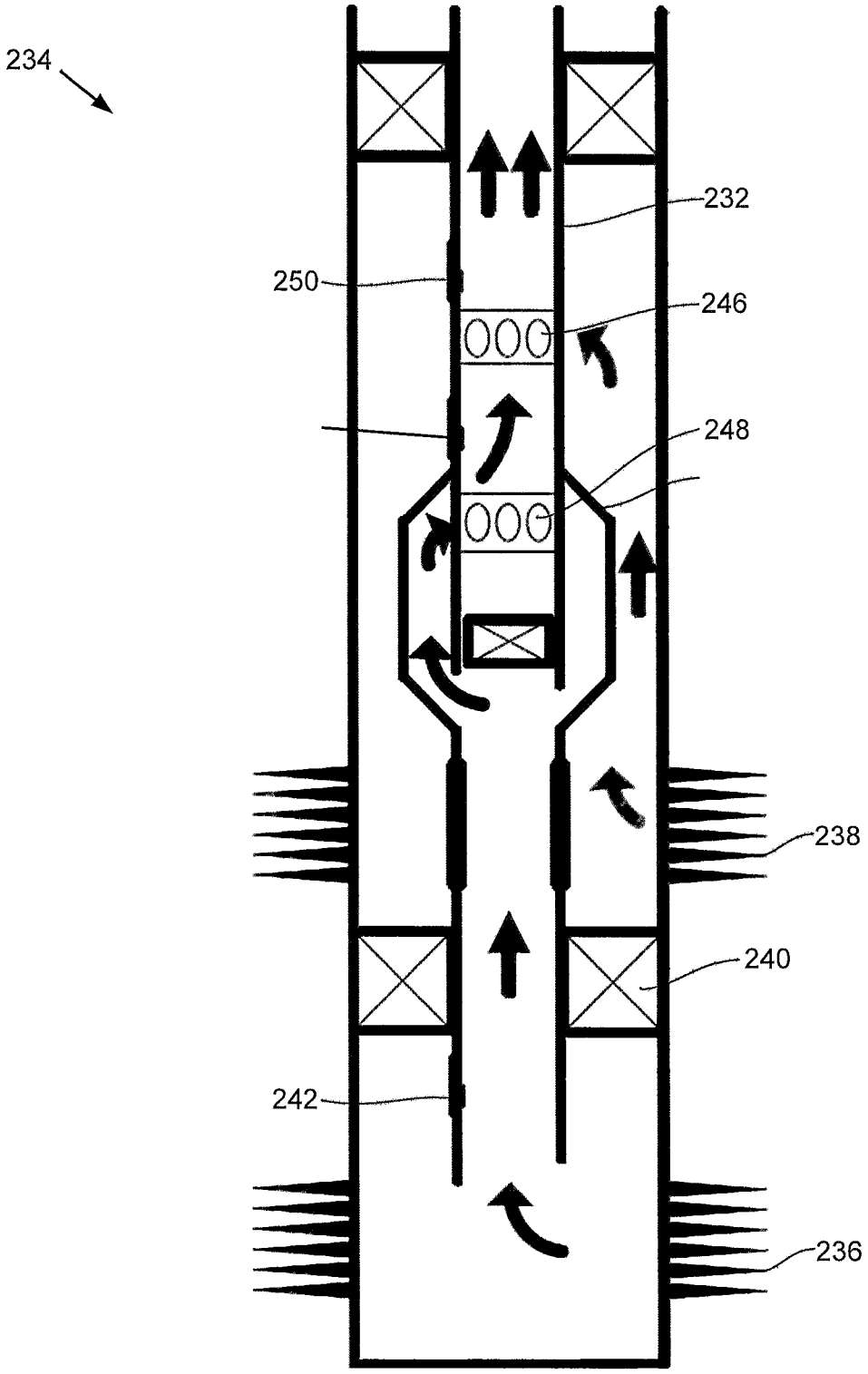

FIGS. 2A, 2B, and 2C illustrate various multiple production zone configurations, in accordance with one or more implementations. More specifically, FIG. 2A illustrates a cased hole commingled production configuration 202 having a lower production zone 204 and an upper production zone 206. An isolation packer 208 isolates fluid flow adjacent to lower production zone 204 such that only that fluid passes by tracer material receptacle 210, and is resultantly marked by tracer material contained in tracer material receptacle 210. Fluid flowing from upper production zone 206 passes through passage 212 (e.g., a sliding side door or inlet valve) and combines with the fluid flowing from lower production zone 204. In some implementations, passage 212 may be opened and closed by remote control. A tracer material receptacle 214 will release tracer material into production tubing 216 responsive to fluid flowing by. The different fluid flows from lower production zone 204 and upper production zone 206 can be quantified by using different distinguishable tracer materials in tracer material receptacle 210 and tracer material receptacle 214. Although two production zones are shown in FIG. 2A (i.e., lower production zone 204 and upper production zone 206), this is not intended to be limiting as more than two production zones may be implemented similarly as in configuration 202.

FIG. 2B illustrates a multi-lateral well configuration 218 having a lower completion 220 and an upper completion 222, each providing separate production zones. An isolation packer 224 isolates fluid flow from lower completion 220 such that only that fluid passes by tracer material receptacle 226, and is resultantly marked by tracer material contained in tracer material receptacle 226. Fluid flowing from upper completion 222 passes through passage 228 (e.g., a sliding side door or inlet valve) and combines with the fluid flowing from lower completion 220. In some implementations, passage 228 may be opened and closed by remote control. A tracer material receptacle 230 will release tracer material into production tubing 232 responsive to fluid flowing by. The different fluid flows from lower completion 220 and upper completion 222 can be quantified by using different distinguishable tracer materials in tracer material receptacle 226 and tracer material receptacle 230. Although two completions (and thus production zones) are shown in FIG. 2B (i.e., lower completion 220 and upper completion 222), this is not intended to be limiting as more than two completions may be implemented similarly as in configuration 218.

FIG. 2C illustrates an intelligent completion configuration 234 having a lower production zone 236 and an upper production zone 238. An isolation packer 240 isolates fluid flow adjacent to lower production zone 236 such that only that fluid passes by tracer material receptacle 242, and is resultantly marked by tracer material contained in tracer material receptacle 242. Some implementations may include tracer material receptacle 242A in addition to or alternatively to tracer material receptacle 242. Individual tracer material receptacles (e.g., 242) may be actuated responsive to instructions received from a remote location in order to expose the corresponding tracer material to wellbore fluids. Fluid flowing from upper production zone 238 flows around shrouded inlet valve 244 and passes through passage 246 (e.g., inlet valve) and combines with the fluid flowing from lower production zone 236 out of passage 248 (e.g., inlet valve). In some implementations, passage 246 and/or passage 248 may be opened and closed by remote control. A tracer material receptacle 250 will release tracer material into production tubing 252 responsive to fluid flowing by. The different fluid flows from lower production zone 236 and upper production zone 238 can be quantified by using different distinguishable tracer materials in tracer material receptacle 242 and tracer material receptacle 250. Although two production zones are shown in FIG. 2C (i.e., lower production zone 236 and upper production zone 238), this is not intended to be limiting as more than two production zones may be implemented similarly as in configuration 234.

Figure 3A:
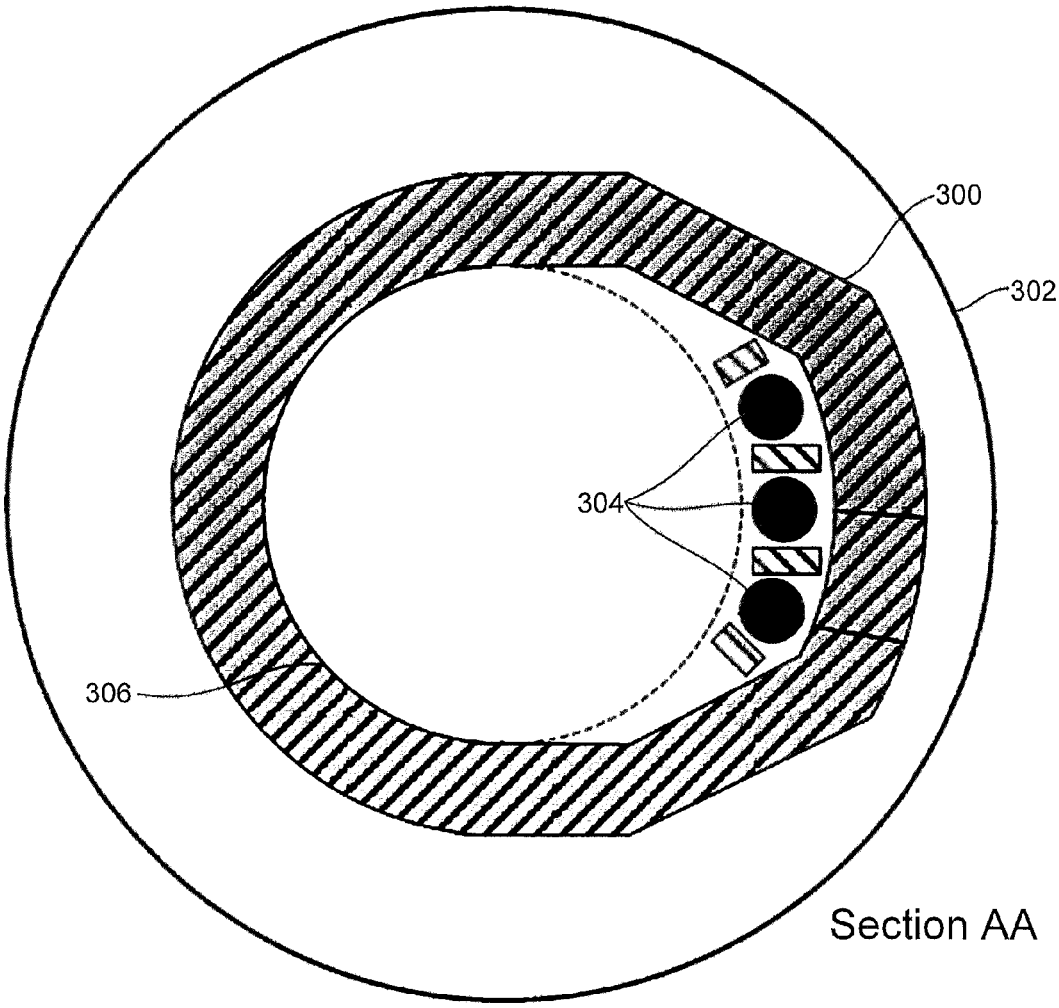
Figure 3B:
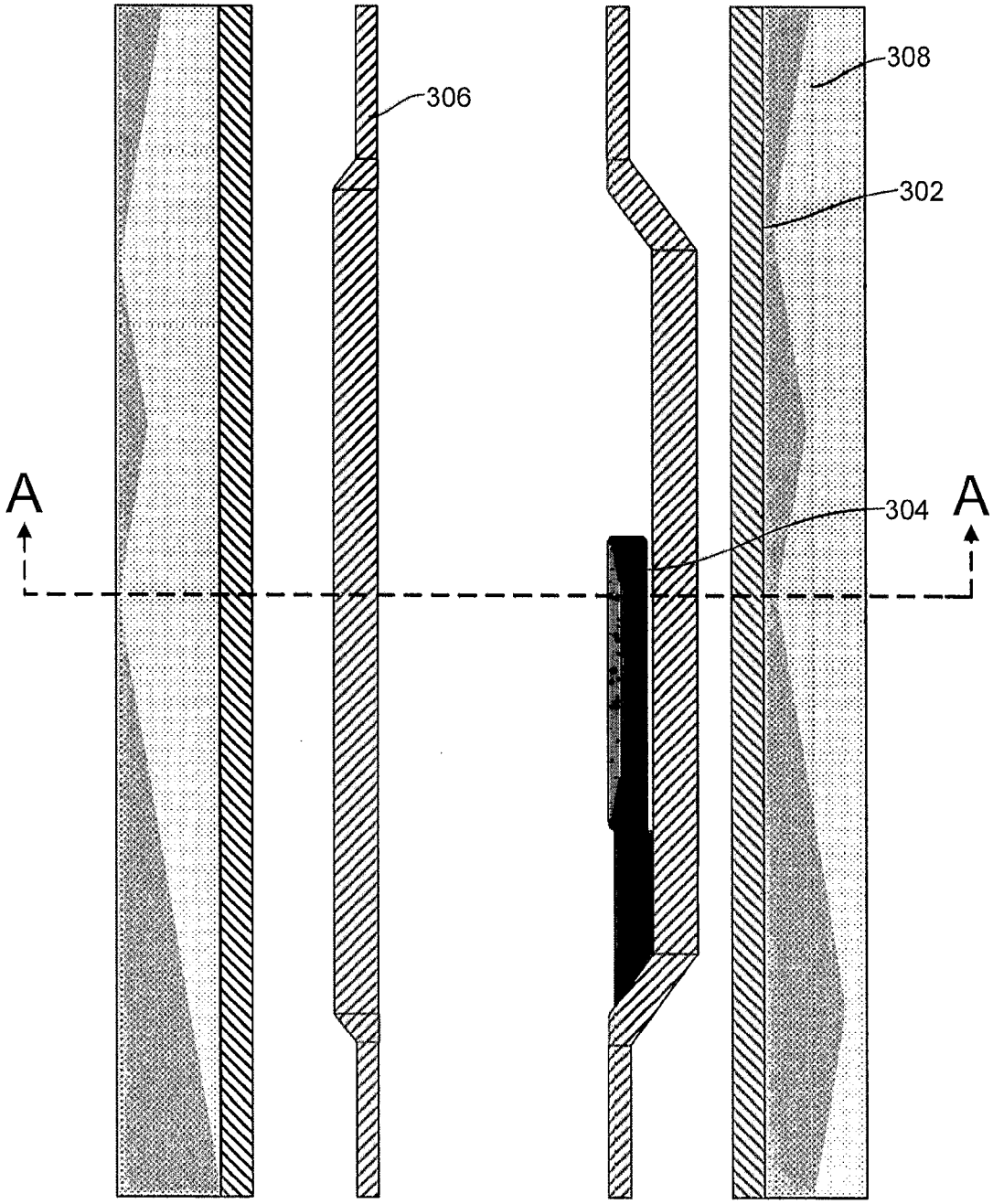
FIG. 3B illustrates an elevation view.

FIG. 3A illustrates a sectional view of a tracer material receptacle assembly 300, while FIG. 3B illustrates an elevation view. The tracer material receptacle assembly 300 is disposed within a wellbore, production liner, or casing 302. Tracer material receptacles 304 are disposed adjacent to full-through bore 306. The production liner or casing 302 may be encased in cement 308.

Figure 4:
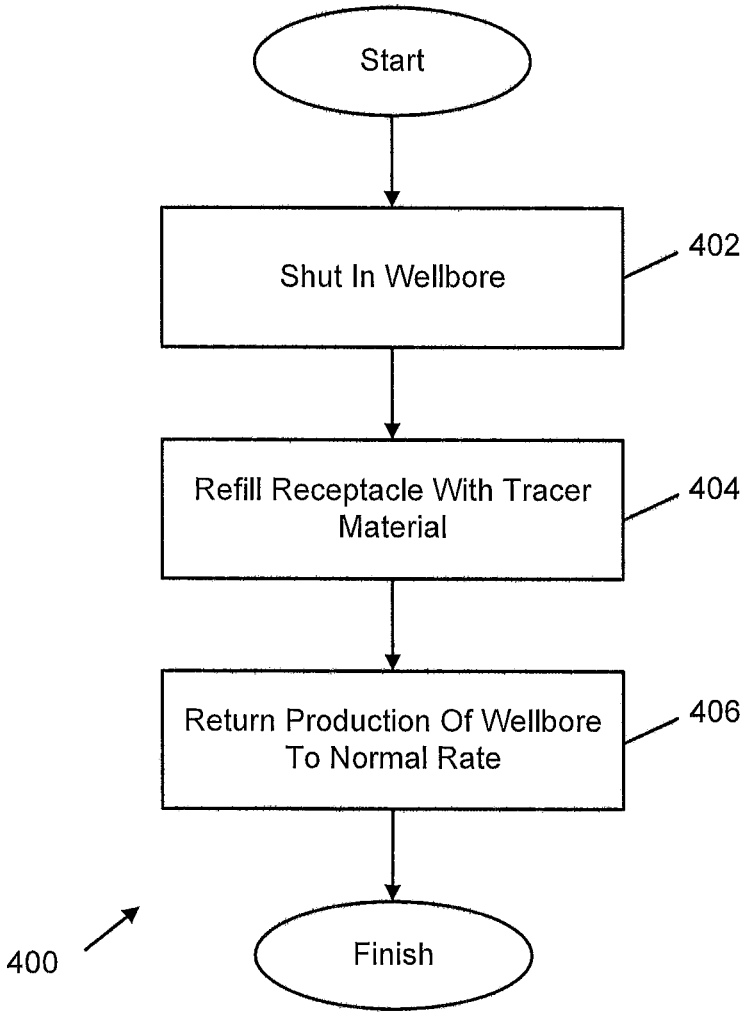
FIG. 4 illustrates a method for replenishing a tracer material receptacle in a wellbore, in accordance with one or more implementations.

FIG. 4 illustrates a method 400 for replenishing a tracer material receptacle in a wellbore, in accordance with one or more implementations. The operations of method 400 presented below are intended to be illustrative. In some implementations, method 400 may be accomplished with one or more additional operations not described, and/or without one or more of the operations discussed. Additionally, the order in which the operations of method 400 are illustrated in FIG. 4 and described herein is not intended to be limiting.

In some implementations, method 400 may be implemented in one or more measuring, processing, power, and/or information storage devices (e.g., a pressure/temperature gauge, digital processor, electrical power sources, capacitors or batteries, an analog processor, a digital circuit designed to process information, an analog circuit designed to process information, a state machine, and/or other mechanisms for electronically processing and storing information). The one or more processing devices may include one or more devices executing some or all of the operations of method 400 in response to instructions stored electronically on one or more electronic storage mediums. The one or more processing devices may include one or more devices configured through hardware, firmware, and/or software to be specifically designed for execution of one or more of the operations of method 400. For example, in some implementations, measurement devices (e.g., pressure, temperature, flow, capacitance, dielectric and/or other instrumentations) may be connected without the receptacle and such that only the processing, power, and/or memory capabilities are removed, replaced, and/or otherwise replenished.

At an operation 402, a wellbore may be shut in such that fluid in the wellbore ceases to flow. The shut in may be performed (at the surface, e.g., Earth's surface, ocean bed surface, and/or other surface) responsive to tracer material contained by a receptacle being depleted (e.g., partially depleted or completely depleted) and/or requiring to be changed out or replenished for other reasons or purposes. In some implementations, operation 402 may be enhanced by closing the inlet valves 116 and 112 (shown in FIG. 1 and described herein).

At an operation 404, the receptacle may be refilled with tracer material. In some implementations, previously installed tracer material (or information and power storage devices) may be removed and alternative or replacement material installed in the receptacle. In some implementations, operation 404 may be performed by or in conjunction with one or more of a wireline, coiled or capillary tubing, a tractor, a robot, tubing from a light intervention vessel, and/or other approaches.

At an operation 406, production of the wellbore may be tested and/or returned to a normal rate responsive to the receptacle being refilled. In some implementations, operation 406 may be performed by opening the surface valves at the wellhead and by opening the inlet valves 112 and 116 (shown in FIG. 1 and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system configured to provide a replenishable receptacle for a tracer material in a wellbore, the system comprising:

a first receptacle configured to contain tracer material and release tracer material into fluid flowing in a wellbore, the tracer material including a distinctive element or chemical configured to facilitate determining information associated with presence and/or movement of fluid in the wellbore;

wherein the release of the tracer material is caused by the fluid flowing adjacent to the first receptacle such that a rate of the release of the tracer material is based on a rate of flow of the fluid in the wellbore; and wherein the first receptacle is further configured to be refilled with tracer material responsive to the tracer material contained by the first receptacle being depleted or require changing.

2. The system of claim 1, wherein the first receptacle is further configured to be installed above or within a producing zone in the wellbore.

3. The system of claim 1, wherein the first receptacle is further configured to be refilled with tracer material via one or more of a wireline, a coiled or capillary tubing, a tractor, a robot, or work-string and/or tubing from a light intervention vessel.

4. The system of claim 1, wherein the first receptacle is further configured to be refilled while the wellbore is shut in or producing at a safe rate.

5. The system of claim 1, wherein the first receptacle is further configured to house a memory device and/or a power storage device, the memory device being configured to measure and/or store information associated with one or more of pressure, temperature, composition, or flow rate of fluid in the wellbore, the power storage device including one or more of an energy source or a battery cell.

6. The system of claim 1, wherein the wellbore is associated with a multi-lateral well, an intelligent well completion, or a commingled completion.

7. The system of claim 1, further comprising a second receptacle, the first receptacle being associated with a first zone in the wellbore and the second receptacle being associated with a second zone in the wellbore, the first receptacle and the second receptacle being configured to contain different types of tracer material to facilitate determination of a first flow rate associated with first zone and a second flow rate associated with the second zone.

8. The system of claim 7, further comprising one or more additional receptacles each being associated with corresponding zones in the wellbore, individual ones of the one or more additional receptacles being configured to facilitate determinations of flow contributions and/or fluids from corresponding zones and/or provide additional options for measurement locations.

9. A method for replenishing a tracer material receptacle in a wellbore, the method comprising:

shutting in the wellbore such that fluid in the wellbore ceases to flow responsive to tracer material contained by the receptacle being depleted, the tracer material including a distinctive element or chemical configured to facilitate determining information associated with movement of fluid in the wellbore;

refilling the receptacle with tracer material; and returning production of the wellbore to a normal rate responsive to the receptacle being refilled, tracer material contained by the receptacle being released into fluid flowing in the wellbore as a result of the fluid flowing adjacent to the receptacle such that a rate of the release of the tracer material is based on a rate of flow of the fluid in the wellbore.

10. The method of claim 9, wherein refilling the receptacle is performed via one or more of a wireline, a tractor, a robot, or tubing from a light intervention vessel.

11. The method of claim 9, wherein the wellbore is associated with a multi-lateral well, an intelligent well completion, or a commingled completion.

* * * * *